US009630804B2

(12) United States Patent
Hovi et al.

(10) Patent No.: US 9,630,804 B2
(45) Date of Patent: Apr. 25, 2017

(54) METHOD FOR PROVIDING WELL ACCESS IN AN ELEVATOR

(71) Applicant: KONE Corporation, Helsinki (FI)

(72) Inventors: Antti Hovi, Hyvinkää (FI); Ari Kattainen, Hyvinkää (FI)

(73) Assignee: KONE CORPORATION, Helsinki (FI)

( * ) Notice: Subject to any disclaimer, the term of this patent is extended or adjusted under 35 U.S.C. 154(b) by 415 days.

(21) Appl. No.: 14/163,805

(22) Filed: Jan. 24, 2014

(65) Prior Publication Data

US 2014/0216856 A1 Aug. 7, 2014

(30) Foreign Application Priority Data

Feb. 6, 2013 (EP) ..... 13154285

(51) Int. Cl.
*B66B 1/20* (2006.01)
*B66B 5/00* (2006.01)

(52) U.S. Cl.
CPC ..... *B66B 5/005* (2013.01)

(58) Field of Classification Search
CPC ..... B66B 5/005
USPC ..... 187/247, 277, 295, 298, 313, 314, 316, 187/380–389, 391, 393
See application file for complete search history.

(56) References Cited

U.S. PATENT DOCUMENTS 5,064,026 A * 11/1991 Nagata ..... B66B 5/0006 187/391
6,223,861 B1 5/2001 Sansevero
7,004,289 B2 * 2/2006 Shrum, III ..... B66B 5/0087 187/393
7,073,633 B2 * 7/2006 Weinberger ..... B66B 5/0025 187/247
7,650,967 B2 * 1/2010 SikShin ..... B66B 1/24 187/249
8,490,755 B2 * 7/2013 Lindberg ..... B66B 13/22 187/314

(Continued)

FOREIGN PATENT DOCUMENTS

CN 1286208 A 3/2001
CN 101112954 A 1/2008

(Continued)

*Primary Examiner* — Anthony Salata
(74) *Attorney, Agent, or Firm* — Birch, Stewart, Kolasch & Birch, LLP

(57) ABSTRACT

A method for providing well access in an elevator well having at least one elevator car moveable in the elevator well, includes the following steps: a well access operating mode of the elevator is activated, in which well access operating mode the elevator car will not respond to any landing calls, group controller commands or to any other remote commands, upon activation of the well access operating mode the car is controlled to travel a set distance up or down, the car is controlled to stop at said distance for a given time, the elevator will automatically exit the well access operating mode and return back to service if within the given time no well entrance, e.g. landing door, is opened. After non authorized activation of the well access operating mode, the elevator is automatically returned to service, which reduces the danger of off-service times of the elevator based on misuse of activation signals.

16 Claims, 1 Drawing Sheet

(56) References Cited

U.S. PATENT DOCUMENTS

| | | | | |
|---|---|---|---|---|
| 8,602,171 | B2 * | 12/2013 | Vogl | B66B 5/005 187/298 |
| 8,863,910 | B2 * | 10/2014 | Sonnenmoser | B66B 13/22 187/249 |
| 9,108,824 | B2 * | 8/2015 | Hughes | B66B 1/34 |
| 9,272,878 | B2 * | 3/2016 | Kocher | B66B 5/005 |
| 2002/0117358 | A1 | 8/2002 | Schoppa et al. | |
| 2008/0047783 | A1 | 2/2008 | Vogl | |
| 2013/0192932 | A1 * | 8/2013 | Parillo | B66B 5/0018 187/289 |
| 2014/0069745 | A1 * | 3/2014 | Dellarippa | B66B 1/34 187/381 |

FOREIGN PATENT DOCUMENTS

| | | | |
|---|---|---|---|
| EP | 1 281 654 | A1 | 2/2003 |
| JP | 2005-206346 | A | 8/2005 |
| JP | 2006-160485 | A | 6/2006 |
| JP | 2010-24015 | A | 2/2010 |
| JP | 2012-96918 | A | 5/2012 |
| WO | WO 2005/095249 | A1 | 10/2005 |

* cited by examiner

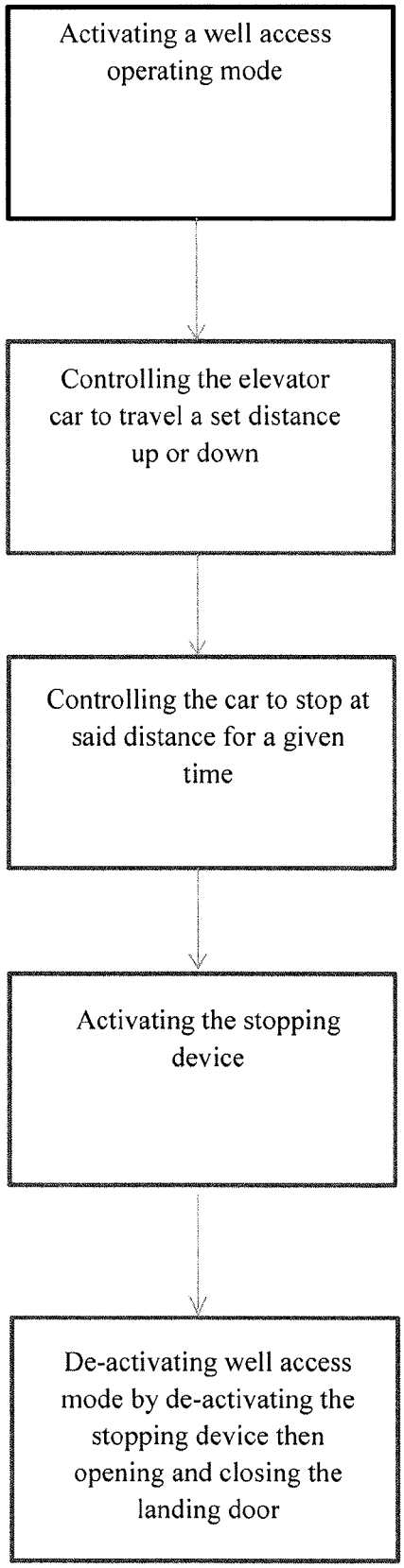
Activating a well access operating mode
Controlling the elevator car to travel a set distance up or down
Controlling the car to stop at said distance for a given time
Activating the stopping device
De-activating well access mode by de-activating the stopping device then opening and closing the landing door

METHOD FOR PROVIDING WELL ACCESS IN AN ELEVATOR

BACKGROUND OF THE INVENTION

The present invention relates to a method for providing well access in an elevator well having at least one elevator car movable in an elevator well or shaft. The method can of course also be performed in elevator groups having several elevator cars moving in several elevator wells.

The U.S. 2008/0047783 discloses a method of controlling access to an elevator well. In this method a code is input in a landing call receiving means whereafter the elevator car is initiated to stop at predetermined stop position.

A disadvantage of this arrangement is that unauthorized persons standing nearby may memorize the code and enter the maintenance mode of the elevator later on without permission. This may result in situations where the elevator is put out of service without any installation or maintenance work being performed on said elevator.

It is object of the present invention to provide a method for providing safe well access in an elevator which reduces misuse dangers.

BRIEF SUMMARY OF THE INVENTION

The invention is solved with a method according to claim 1 and an elevator according to the claim 10. Preferred embodiments of the invention are subject-matter of the corresponding dependent claims. Furthermore, the inventive content of the application may also consist of several separate inventions, especially if the invention is considered in the light of explicit or implicit sub-tasks or in a respect of advantages or sets of advantages achieved. In this case, some of the attributes contained in the claims below may be superfluous from the point of view of separate inventive concepts. Within the framework of the basic concept of the invention, features of different embodiments of the invention can be applied in conjunction with other embodiments.

BRIEF DESCRIPTION OF THE DRAWINGS

The FIGURE is a block diagram of the method for providing well access in an elevator well.

DETAILED DESCRIPTION OF THE INVENTION

The inventive method comprises a succession of the following steps as illustrated in the FIGURE:

a) A well access operating mode of the elevator is activated in which well access operating mode the elevator car will not respond to any landing calls, group controller commands or any other remote commands.

Of course, the elevator car may still respond to any emergency commands which are prescribed by national or international safety regulations, e.g. in case of fire. Anyway, this step ensures that the elevator car cannot be called from any passenger of the elevator system.

b) Upon activation of the well access operating mode, the car is controlled to travel a set distance away from the landing where the activation call has been given.

Preferably, this distance is not a distance to a next landing so that the elevator car stops at a defined position in the elevator well without passengers being able to enter the car. It is of course also possible that this distance corresponds to one or more landing distances up or down. But in this case the car doors and landing doors should remain closed so as to prevent access to the elevator car by any passengers. In any case it is preferable that a car door open button is provided within the car which is active at an unlocking zone, i.e. door zone to allow persons inside the car to exit. The set distance may either be predetermined or may be set by a service technician in connection with the activation of the well access operating mode. These options may also be combined insofar as predetermined values for the distance may be overwritten by a service technician in connection with the activation. Advantageous distances for the travel of the elevator car in step b) range from 1 m to 3 m, but also other distances are possible.

c) The car is controlled to stop at said distance for a given time.

The elevator car is controlled to stop at said predetermined distance for a given time. This time should be enough for the service technician to open the landing door to get access to the well. Thus this time could preferably range from 5 s to 1 min, but may also be longer This time is intended to allow the service technician to enter the elevator well by opening a well entrance, for example a landing door of the elevator well. The well entrance, e.g. the landing door, may be opened via a special key (typically a triangle key in line with EN 81-1, Annex B) which excludes the access to the elevator well to any other people than the operating or maintenance persons.

d) If within the given time no well entrance, e.g. landing door, is opened, the elevator automatically exits the well access operating mode and returns back to service.

This feature prevents the result of an elevator being out of service after unauthorized issue of the activation code by other persons than the operating or maintenance persons. If an unauthorized activation of the well access operating mode is performed, the elevator automatically goes back into normal service after having waited the given time, which is preferably not longer than 5 minutes.

Of course, if during this given time a well entrance, e.g. the landing of the elevator is opened, the safety chain is interrupted and this would lead to the deactivation of the motor control and to the gripping of the motor brake by de-energizing the holding magnets of the motor brake. This is the normal result in line with safety regulations when a person enters the elevator well, particularly via the landing door.

When entering the well the service technician normally activates a further stopping device that prevents the elevator car from starting unexpectedly when the service technician is performing maintenance-, service- or monitoring actions in the elevator well. After these actions are terminated, the service technician deactivates the stopping device, leaves the elevator well and closes the well entrance, e.g. the landing door. Now after the stopping device is deactivated and the landing door is closed the well access operating mode could automatically put the elevator back into use or the elevator car can be put into use manually by any action in connection with the elevator control.

The return to normal service after deactivation of any stopping device and/or inspection operation switches can also be performed as normal maintenance procedure without the well access maintenance mode being still activated. In this case, the well access activation mode exits either after the given time period has lapsed without the well being opened or after a well entrance, e.g. the landing door, has been opened. The well entrance may also be another opening than a landing door, e.g. a hatch or plate.

Optionally, the elevator car could return to normal service mode after deactivation of the stopping devices and/or inspection operation switches but only after the landing door is first seen open and then closed again. In this case a monitoring device in connection with the elevator control, which could for example be provided in the elevator car, monitors if really all well entrances are closed and only if this is the case and the stopping device and/or inspection operate switches are deactivated, the elevator is put back to use either automatically or via additional manual action of the service technician, e.g. pressing a corresponding 'back to use' button. Optionally this 2back to use" switch can be integrated in the unlocking triangle (keyhole mechanism for the well access key carried by the service technician. E.g. when the triangle key is turned in one direction it opens the landing door lock. When the triangle key is turned in the opposite direction the key operates the above mentioned switch, e.g. an electric contact, which resets the well access operating mode and turns the elevator back to normal use. Of course also a signal from the safety chain can be used for said purpose.

Preferably, once the well access operating mode of the elevator has been activated and a well entrance has not been opened afterwards or a reset switch has not been operated, a delay time may be set so as to delay a further activation of the well access operating mode within a certain time frame. This delay time may preferably range between 5 min and 1 h. Of course, also other delay times may be set in the elevator control for such circumstances.

In a preferred embodiment of the inventive method, the elevator car is first called to a landing from where the well shall be entered and after the elevator car has arrived at said landing the well access operating mode is activated. This step which is to be performed before step a) has the advantage that the service technician is able to verify that the elevator car is empty before it is controlled via the well access operating mode to travel the said distance up or down. In this connection, it is possible that after the car has reached said landing, the well access operating mode is activated from inside of the elevator car or via a landing call terminal of said landing lobby from where the well shall be entered. In both cases the service technician can verify that the elevator car is emptied before step a) is provided and that the elevator car is driven empty in its stopping position so that the entrapment of persons can be effectively excluded.

Of course, it is also possible, that the activation of the well access operating mode includes as a first step before a) the drive of the elevator car to the landing where the well access operating mode has been activated. Then, only after verification of an empty car step a) is performed. The verification may e.g. be input by the service technician via an input means in the car or at the landing.

In a preferred embodiment of the invention, the travel direction of the elevator car in step b) is dependent on the location of the elevator car in the well. If, for example, the landing from where the well access operating mode is activated is in the top area of the elevator well, the elevator car is initiated to travel down in step b). If the landing is in the lower part of the elevator well, the elevator car is initiated to travel upwards in step b). Via this measure, the service technician has not the obligation to care about the travel direction of the elevator car.

Anyway, it could be optionally possible to input also the distance and the direction of the car travel in step b) in connection with the activation of the well access operating mode. In this case, the car travel in step b) is not performed based on preset values of the distance and direction of the car travel but on values input in connection with the activation of the well access operating mode. This possibility could be provided optionally additionally to the sole activation of the well access operating mode and allows the service technician to consider special circumstances where when the elevator car should parked at different positions from the normal preset positions.

Of course, it is also possible only to use values and directions of the distance which are given together with the activation of the well access operating mode, in which case the system works without any preset values. Anyway, in this case the elevator control should be able to accept only values and directions for the car travel in step b) which are acceptable for the elevator system. Therefore, preferably, in case the travel direction and/or the travel distance of the elevator car for step b) is/are given manually the elevator control should perform any verification of the input values.

The invention also relates to an elevator comprising an elevator control and at least one elevator car travel in an elevator well. The elevator control comprises a well access operating part which is responsible for the operation of the elevator in the well access operating mode. After the activation of the well access operating mode, the well access operating part controls the elevator car to travel a said distance up or down from a landing. The landing is preferably said landing from which the well access operating mode has been activated. After having travelling said distance, the elevator car is controlled to stop at said predetermined distance for a given time. Preferably, this distance is a distance different than the distance to a next landing which results in a situation where the elevator car stops in the elevator well with closed doors without having contact to any landing doors so that passengers cannot enter the elevator car.

Another possibility is to control the elevator car to be driven up or down a distance which corresponds a landing pitch but in this case the elevator car stops in said position with door closed and also the corresponding landing doors closed. In this connection it has to be mentioned that usually landing doors are operated by the elevator car together with the elevator car doors in an automatic door system of modern elevators.

The elevator car could comprise in a preferred embodiment of the invention a receiving means for the input of an activation signal (e.g. a pin-code) for the well access operating mode. For example, this could be a car call panel, a keyhole matching to a key of the service technician, any switches which should be not accessible to non-authorized persons. Of course, also modern electronic components could be used for the activation, as for example card readers located in the elevator car, which are able to read an ID card of the service technician, NFC devices, or any connections or receivers for service tools. The connections could be either wire-based wireless.

The same components could be provided at all or certain landings, for example the uppermost or lowermost landing to input an activation signal for the well access operating mode via buttons, keyholes, switches, card readers, NFC devices, connections or receivers for service tools. The activation means in the car and on the landing can be provided alternatively or additionally. Preferably, these components are provided in connection with landing call input terminals. This reduces the technical effort and provides a safe and closed environment for the input means.

Of course by using input means which are not commonly accessible buttons, a misuse by unauthorized persons can effectively be prevented. Anyway, the use of the commonly available buttons has the advantage that no separate input means for the well access operating mode has to be provided.

Preferably, the well access operating part of the elevator control obtains signals from switches provided in connection with well entrances, e.g. all or certain landing doors and/or preferably signals of stopping devices in the elevator well which are used by service technicians to avoid the crushing down of an elevator into a working space. Via these signals the well access operating part is able to monitor the status of stopping means and the opening status of all landing doors. Accordingly, the well access operating part is able to put the elevator back to use after the maintenance or service is terminated.

Preferably, the well access operating part of the elevator control is configured to exit the well access operating mode and return the elevator back to use if all at least one well entrance is first opened and afterwards all well entrances are closed and any stopping device in the well is deactivated. Via this means it can be ensured that the elevator well is empty so that the danger of crushing people in the well is excluded. The automatic reset of the elevator car to normal use further reduces the off-service times of the elevator. Optionally, a reset with a switch is provided on that behalf, which is e.g. operated via a (triangle) key turned e.g. in opposite direction to the unlock direction.

Preferably, a lock mechanism for a landing door is provided comprising a reset switch for resetting the well access operating mode. Via this measure the well access mode can easily be reset (terminated) after the service technician has terminated his work in the well and operates the lock mechanism to operate the reset switch, which of course also is the locking direction of the lock.

On that behalf the lock mechanism has preferably a first operating direction to unlock the landing door and a second, preferably opposite operating direction to operate the reset switch. This allows an easy locking and unlocking the door as well as resetting of the well access operating mode. Of course, in this second operating direction the landing door is locked.

In line with EN 81-1, Annex B the lock mechanism is preferably configured to be operated via a triangle key.

Optionally, a correction drive of the elevator car be provided before the car is put back into service. The correction drive is preferable to the next landing, particularly to the floor level where the service technicians entered the well or any predetermined position in the elevator well. Via such a step the car may be returned to a normal operating position.

Following advantages of the inventive solution are obtained:

The invention reduces the risk of accidents of operating persons or service technicians. It reduces tripping and falling hazard. The invention also reduces stress and the loading of the equipment because the stopping at the set position can be done by slowly driving the elevator to said position without breaking the elevator from full speed.

Furthermore, the access method of the present invention is usable at every landing and not just at the top and bottom floor. The invention also saves costs and improves the reliability because less wiring electric and electronic components are required.

In contrast to U.S. 2008/0047783, the activation of the well access operating mode can be performed by many different methods where the service technician is not in view of curious watchers. This prevents misuse of the activation signal by unauthorized persons.

If nevertheless (e.g. by inputting a code into the car or landing call panel) the input of the well access operating mode is watched by any curious watcher and the watcher later activates the well access operating mode but the landing door is not opened (which is not possible for unauthorized persons), the lift will not be blocked out of service but after lapse of the predetermined time, the well access operating mode is terminated automatically and the elevator is automatically returned back to use. This efficiently reduces any out of service times of the elevator.

The well access operating part of the elevator control can be provided on a separate module but can also be provided as an algorithm in the elevator control. The well access operating part of the elevator control can be integrated with the elevator control or can be provided in a separate location. Preferably, after activation of the well access operating mode, the elevator control controls the displays at the landings to indicate that the elevator is out of service.

The invention is not restricted to the above embodiments but can be varied within the scope of the appended patent claims.

The invention claimed is:

1. A method for providing well access in an elevator well having at least one elevator car moveable in the elevator well, comprising the steps of:

activating a well access operating mode of the elevator, in which well access operating mode the elevator car will not respond to any landing calls, group controller commands or to any other remote commands, upon activation of the well access operating mode, controlling the car to travel a set distance up or down; and controlling the car to stop at said distance for a given time;

wherein the elevator will automatically exit the well access operating mode and return back to service if within the given time no well entrance is opened, and wherein a stopping device of the elevator is activated during or after opening of the well entrance and wherein after any maintenance and/or inspection actions are terminated, the stopping device is de-activated and after opening and then closing the landing door the elevator is automatically taken back into use.

2. The method according to claim 1, wherein, if a well entrance is opened during the given time, the car remains stopped until the well entrance is closed again and/or the elevator is returned back into service.

3. The method according to claim 1, wherein the elevator car is first called to the landing from where the well shall be entered and after the elevator car has reached said landing the well access operating mode is activated.

4. The method according to claim 3, wherein, when the car has reached said landing, the well access operating mode is activated from the inside of the elevator car and the car is emptied/left empty before step b) is started.

5. The method according to claim 1, wherein the well access operating mode is activated via an input to a landing call terminal of a landing from where the well shall be entered and after activation of the well access operating mode the elevator car first travels to said landing to empty the elevator car before step b) is started.

6. The method according to claim 1, wherein the elevator car travels up or down in step b) dependent on the current location of the elevator car in the well.

7. The method according to claim 1, wherein with the activation of the well access operating mode also the distance and direction of the car travel in step b) are set.

8. The method according to claim 1, wherein a delay time for the acceptance of a new input of a well access operating mode activation signal will be established by the elevator control if the well access operating mode has been activated without a well entrance having been opened within the given time.

9. An elevator comprising: an elevator control; and at least one elevator car traveling in an elevator well, wherein the elevator control comprises a well access operating part for operating the elevator in a well access operating mode in which after its activation the elevator car is controlled to travel a set distance up or down from a landing which distance is not the distance to a next landing, and whereafter the car is controlled to stop at said predetermined distance for a given time, whereby the elevator control is configured to automatically exit the well access operating mode and return back to service, if during the given time no entrance to the well is opened, and wherein the well access operating part of the elevator control obtains signals from switches provided in connection with the well entrances, of any stopping devices in the elevator well, wherein the well access operating part of the elevator control is configured to exit the well access operating mode if all well entrances are closed and any stopping device in the well is deactivated.

10. The elevator according to claim 9, wherein the elevator car comprises means for receiving an activating signal for the well access operating mode, e.g. buttons, keyholes, switches, card readers, NFC devices, connections or receivers for service tools.

11. The elevator according to claim 9, comprising a destination call panel at the landings comprising means for receiving an activating signal for the well access operating mode, in the form of buttons, keyholes, switches, card readers, NFC devices, connections or receivers for service tools.

12. The elevator according to claim 9, wherein a lock mechanism for a landing door is provided comprising a reset switch for resetting the well access operating mode.

13. The elevator according to claim 12, wherein the lock mechanism has a first operating direction to unlock the landing door and second, preferably opposite operating direction to operate the reset switch, in which second operating direction the door is locked.

14. The elevator according to claim 12, wherein the lock mechanism is configured to be operated via a triangle key.

15. The method according to claim 2, wherein a stopping device of the elevator is activated during or after opening of the well entrance, e.g. landing door in step e).

16. The method according to claim 2, wherein the elevator car is first called to the landing from where the well shall be entered and after the elevator car has reached said landing the well access operating mode is activated.

* * * * *